US005633620A

United States Patent [19]

Doerrwaechter

[11] Patent Number: 5,633,620

[45] Date of Patent: May 27, 1997

[54] ARC CONTAINMENT SYSTEM FOR LIGHTNING SURGE RESISTOR NETWORKS

[75] Inventor: Bernhard Doerrwaechter, Oconomowoc, Wis.

[73] Assignee: Microelectronic Modules Corporation, New Berlin, Wis.

[21] Appl. No.: 578,867

[22] Filed: Dec. 27, 1995

[51] Int. Cl.[6] ..... H01C 7/10

[52] U.S. Cl. ..... 338/21; 338/195; 338/308; 361/117

[58] Field of Search ..... 338/20, 21, 25, 338/195, 275, 308, 309, 314; 361/1, 117; 174/50.5

[56] References Cited

U.S. PATENT DOCUMENTS

| | | | |
|---|---|---|---|
| 3,271,625 | 9/1966 | Caracciolo . | |
| 4,074,221 | 2/1978 | Milligan | 338/21 |
| 4,139,832 | 2/1979 | Yoshino et al. | 338/308 |
| 4,284,970 | 8/1981 | Berrin et al. | 338/195 |
| 4,647,900 | 3/1987 | Schelhorn et al. | 338/314 |
| 4,788,524 | 11/1988 | Ozaki | 338/309 |
| 4,961,065 | 10/1990 | Taylor | 338/308 |
| 5,084,693 | 1/1992 | Taylor et al. | 338/306 |
| 5,097,247 | 3/1992 | Doerrwaechter | 337/405 |
| 5,184,108 | 2/1993 | Bloom et al. | 338/195 |
| 5,262,754 | 11/1993 | Collins | 338/21 |
| 5,363,277 | 11/1994 | Tanaka | 361/760 |
| 5,402,100 | 3/1995 | Urbanek et al. | 338/21 |

FOREIGN PATENT DOCUMENTS

| | | | |
|---|---|---|---|
| 374-007 | 12/1988 | France | 174/50.5 |
| 2-276201 | 11/1990 | Japan | 338/256 |
| 6-13533 | 1/1994 | Japan | 361/736 |

*Primary Examiner*—Tu B. Hoang
*Attorney, Agent, or Firm*—Reinhart, Boerner, Van Deuren, Norris & Rieselbach, s.c.

[57] ABSTRACT

A lightning surge resistor network includes a ceramic substrate and a thick-film resistor deposited onto the substrate. To prevent material spatter and to contain and isolate any arcing that can occur in the event the thick-film resistor opens during a severe over voltage condition, a ceramic cover is mounted over the thick-film resistor. The thick-film resistor is thus fully contained between the ceramic substrate and the ceramic cover. Preferably, the ceramic cover is adhered to the ceramic substrate by means of an adhesive film deposited onto either the cover or the substrate adjacent the outer periphery of the cover. Preferably, the mount of adhesive is reduced at preselected locations along the outer periphery of the cover to form weakened areas in the seal between the cover and the substrate. The weakened areas permit gasses to escape in a predetermined direction in the event excessive pressures are formed under the cover when the thick-film resistor opens under an over voltage condition. Preferably, the adhesive is deposited in a pattern that subdivides the volume under the cover into a plurality of cells or isolation areas. The isolation areas form pockets that contain the arcing and help provide faster clearing times.

29 Claims, 1 Drawing Sheet

ARC CONTAINMENT SYSTEM FOR LIGHTNING SURGE RESISTOR NETWORKS

BACKGROUND OF THE INVENTION

This invention relates generally to thick-film resistor networks and, more particularly, to thick-film resistor networks used for lightning surge protection in telecommunications systems.

Lightning surge resistor networks are well-known in the telecommunications industry. Such networks, which typically comprise a thick-film resistor formed on a ceramic substrate, are used to terminate individual telecommunications lines. In addition to providing impedance matching, such networks protect the telecommunications circuitry from over voltage conditions that can result when a lightning bolt strikes on or near a telecommunications line.

Ordinarily, lighting surge resistor networks are designed to withstand a typical over voltage condition without incident. Sometimes, however, a non-typical or severe over voltage condition occurs that is sufficient physically to destroy the lightning surge resistor network. This can happen, for example, when a particularly strong lightning bolt hits the telecommunications line. Or it can happen when an alternating-current power line strung adjacent the telecommunications line falls onto the telecommunications line and delivers the full power line voltage to the telecommunications line. When such severe over voltage conditions occur, it is not unusual for the thick-film resistor element in the lightning surge resistor network to open in a shower of sparks, much in the manner of a fuse. Although such self-destruction by the resistor network is effective to protect the downstream telecommunications equipment, the resulting "fireworks" can be problematic. Molten matter sprayed onto adjacent electronic components can cause short circuits, and uncontained arcing creates the potential for fires. Good design practice requires that such adverse consequences be avoided.

One known approach to avoiding such adverse consequences involved coating the thick-film resistor with an epoxy coating. The coating helped avoid spraying adjacent components with ejected matter when the thick-film resistor opened. Another known approach was to scribe lines into the ceramic substrate on which the thick-film resistor was deposited. The scribed lines formed stress concentrations that would crack the substrate and thereby open the resistor when the resistor overheated in an over voltage condition. Although effective in allowing the resistor to open in a controlled, non-dramatic manner, the approach did not work fast enough in extreme (i.e., 600+ VAC) over voltage conditions. Under such conditions, uncontrolled arcing could still occur.

SUMMARY OF THE INVENTION

The invention provides a lightning surge resistor network having a substrate, a thick-film resistor deposited on the substrate and a cover overlying the thick-film resistor so that the thick-film resistor is enclosed between the substrate and the cover.

The invention also provides a method of making a lightning surge resistor network comprising the steps of providing a substrate, depositing a thick-film resistor onto the substrate and covering the thick-film resistor with a cover so that the thick-film resistor is fully enclosed between the substrate and the cover.

In one embodiment, the substrate and the cover are each formed of ceramic.

In one embodiment, the subtrate and cover are bonded to each other with an epoxy adhesive.

In one embodiment, the adhesive subdivides the volume defined between the cover and the substrate into a plurality of subdivisions or cells.

In one embodiment, the adhesive is made thinner at certain points to create predetermined weakened areas that will fail in a controlled manner in the event excessive pressures are built up between the substrate and the cover.

It is an object of the present invention to provide a new and improved lightning surge resistor network.

It is a further object of the present invention to provide a new and improved lightning surge resistor network that avoids material spray and uncontained arcing in the event of a severe over voltage condition.

It is a further object of the present invention to provide a new and improved lightning surge resistor network that effectively contains arcing and that can be manufactured reliably and economically.

BRIEF DESCRIPTION OF THE DRAWINGS

The features of the present invention that are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DESCRIPTION OF THE PREFERRED EMBODIMENT

Figure 2:
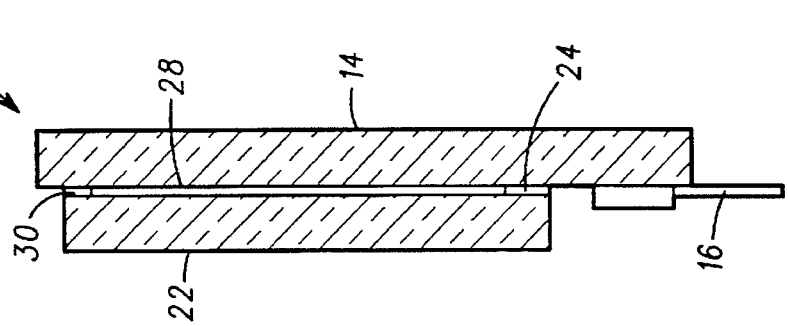
FIG. 2 is a cross-sectional view of the lightning surge resistor network shown in FIG. 1 taken along line 2—2 thereof.
Figure 1:
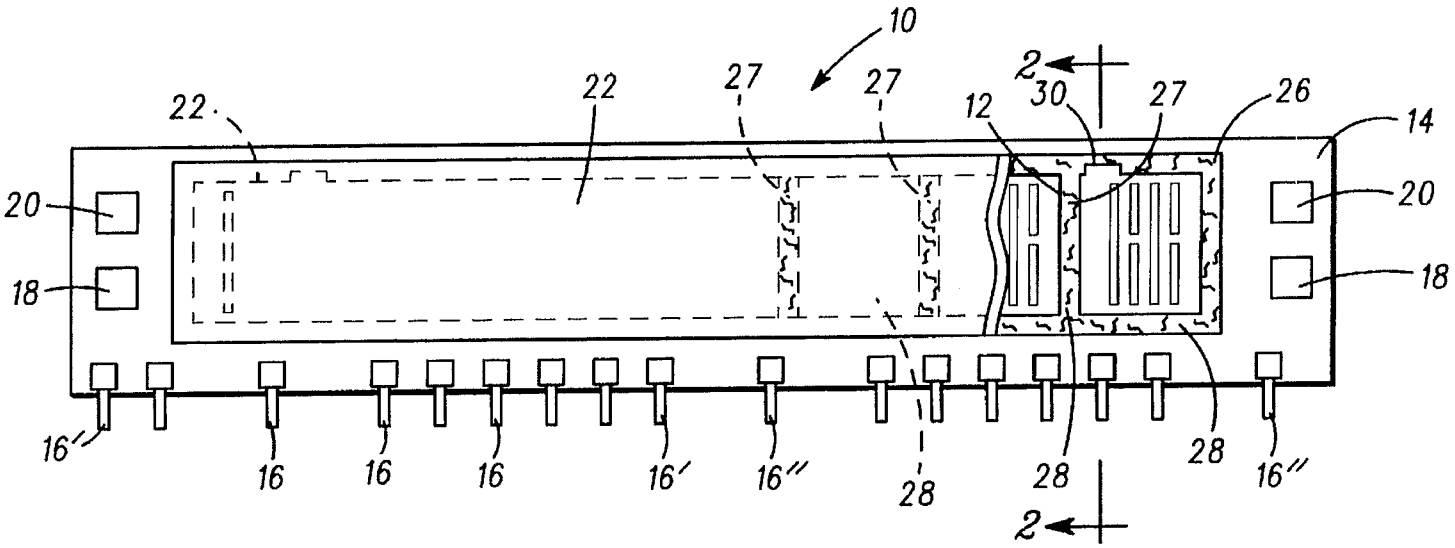
FIG. 1 is a front elevation view of a thick-film hybrid lightning surge resistor network having an arc containment enclosure embodying various features of the invention.

Referring to the drawings, a lightning surge resistor network is shown at 10. The lightning surge resistor network 10 is preferably formed using known thick-film hybrid circuit techniques and includes a serpentine thick-film resistor element 12 disposed on a ceramic substrate 14. Although a serpentine resistor pattern is shown, it will be appreciated that other topographies, such as rectangular, can be used. In the illustrated embodiment, the substrate 14 comprises 96% Alumina. Alternatively, other materials, such as printed circuit (pc) board material (FR4) can be used as the substrate. A palladium/silver (PdAg) base metal is deposited onto the substrate through screen printing techniques as is the thick-film resistor 12.

Electrical connection to the thick-film resistor 12 is made through a plurality of terminal pins 16 disposed along the lower edge of the substrate 14. In the illustrated embodiment, the lightning surge resistor network 10 includes two separate thick-film resistors 12 that are mounted on the single substrate 14 and are electrically accessed through two pairs of terminal pins 16' and 16". Preferably, a fuse element (not shown) is series-connected with each of the thick-film resistors 12 across a pair of mounting pads 18 and 20 associated with each resistor 12. In the illustrated embodiment, the substrate 14 is of elongate, rectangular, planar form and is substantially longer and wider than it is thick. The substrate 14 stands vertically as shown in the figures when the lightning surge resistor network 10 is installed on a circuit board.

In accordance with one aspect of the invention, steps are taken to prevent material spatter and to isolate arcing in the event a severe over voltage or over current condition exists in either of the thick-film resistor elements 12. In the illustrated embodiment, an arc containment shield or cover 22 is mounted over the thick-film resistor elements 12. Preferably, the cover 22 comprises a rectangular, planar plate that is formed of the same ceramic material as the substrate 14 and is of similar or lesser thickness. As illustrated, the cover 22 is of smaller rectangular dimension than the substrate 14 and is dimensioned to overlie the area of the substrate 14 containing the thick-film resistor elements 12. The cover 22 is bonded to the substrate 14 by means of a polymer adhesive 24, such as Epoxy, disposed between the substrate 14 and the cover 22 adjacent the outer periphery of the cover 22. Preferably, the adhesive 24 is deposited onto the substrate 14 around the thick-film resistor elements 12 in a predetermined pattern 26 using screen printing techniques. Preferably, the pattern 26 not only includes a portion that lies adjacent the outer periphery of the cover 22 but further includes one or more cross-segments or fingers 27 that subdivides the area surrounded by the pattern 26 into a plurality of smaller, bounded, isolation areas or cells 28. The cover 22 is then placed over the substrate 14 and the adhesive 24 is allowed to cure.

The cover 22 and the substrate 14 thus fully enclose the thick-film resistor elements 12. In the event either thick-film resistor element 12 is destroyed by an over voltage or over current condition, the material that is vaporized or otherwise ejected in the process is contained by the substrate 14 and cover 22 and is prevented from spraying onto adjacent circuit components. Similarly, any arcing that occurs in the process is physically isolated from the adjacent circuitry to reduce the possibility of starting a fire. The cells 28 defined by the adhesive pattern 26 create internal spaces or voids under the cover 22 that provide room for gases to expand in the event of an over voltage or over current condition. In addition, by subdividing the area under the cover 22 into a plurality of smaller cells 28, the mount of arcing that results during an over current condition is reduced. It is believed that this results from the limiting effect such subdivision has on the amount of oxygen available for combustion in the immmediate area of the arc. This has the further effect of reducing the arc time and hence improving the "clearing time" of the lightning surge resistor network 10.

In one preferred form of the invention, the adhesive pattern 26 is not of uniform width throughout but includes one or more relief areas 30 of reduced width. The relief areas 30 contain less adhesive 24 than the other areas and thus create controlled "weak spots" or weakened areas where the cover 22 is less securely adhered to the substrate 14 than in the other areas. In the event the destruction of the thick-film resistor elements 12 creates sufficient pressure under the cover 22 to physically breach the integrity of the arc containment enclosure, the enclosure will fail in a controlled manner at the preselected "weak spots" rather than randomly elsewhere. In the illustrated embodiment, the "weak spots" are located along the upper edge of the lightning surge resistor network 10 so that any gases thus released are directed upwardly away from adjacent circuitry.

The arc containment system and method provided by the present invention ensure that the lightning surge resistor network 10 will fail in a safe, controlled manner in the event of an over voltage incident rather than in an uncontrolled shower of sparks and spray. This significantly reduces the possibility of damaging or short-circuiting adjacent circuitry and reduces the risk of fire as well.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A lightning surge resistor network comprising:

a substrate;

a thick-film resistor deposited on said substrate; and a cover overlying and being spaced a distance above said thick-film resistor so that said thick-film resistor is between said substrate and said cover.

2. A lightning surge resistor network as defined in claim 1 wherein said substrate and said cover are each substantially planar in form.

3. A lightning surge resistor network as defined in claim 2 wherein said cover is adhered onto said substrate by means of an adhesive.

4. A lightning surge resistor network as defined in claim 3 wherein said cover includes an outer periphery and said adhesive is located adjacent said outer periphery.

5. A lightning surge resistor network as defined in claim 4 wherein said outer periphery of said cover completely surrounds said thick-film resistor.

6. A lightning surge resistor network as defined in claim 5 wherein said adhesive is distributed onto said substrate.

7. A lightning surge resistor network as defined in claim 6 wherein said adhesive film is of reduced dimension adjacent preselected locations of said outer periphery so as to form areas of reduced adhesive strength adjacent said preselected locations.

8. A lightning surge resistor network as defined in claim 6 wherein said adhesive film further includes at least one cross-segment extending between points on said outer periphery so as to subdivide the region surrounded by said outer periphery into a plurality of cells.

9. A lightning surge resistor network as defined in claim 8 wherein any arcing that occurs in said thick-film resistor is confined within the cell in which said arcing occurs.

10. A lightning surge resistor network as defined in claim 8 wherein said adhesive film is of reduced dimension adjacent preselected locations of said outer periphery so as to form areas of reduced adhesive strength adjacent said preselected locations.

11. A lightning surge resistor network as defined in claim 1 wherein said substrate is formed of ceramic.

12. A lightning surge resistor network as defined in claim 1 wherein said cover is formed of ceramic.

13. A lightning surge resistor network as defined in claim 1 wherein said substrate and said cover are formed of printed circuit board material.

14. A lightning surge resistor network as defined in claim 1 wherein said cover is adhered to said substrate with an epoxy adhesive.

15. A lightning surge resistor network as defined in claim 1 wherein said resistor network includes a plurality of said thick-film resistors deposited onto said substrate.

16. A method of containing arcing in a lightning surge resistor network of the type having a thick-film resistor deposited onto a substantially planar substrate, said method comprising the steps of:

providing a cover of sufficient dimension to overlie substantially the entire thick-film resistor; and, mounting the cover over and being spaced a distance above the thick-film resistor.

17. A method as defined in claim 16 further comprising the step of adhering the cover to the substrate by means of an adhesive.

18. A method as defined in claim 17 further comprising the step of depositing the adhesive between the cover and the substrate in a predetermined pattern.

19. A method as defined in claim 18 further comprising the step of forming the pattern so as to subdivide the volume defined between the cover and the substrate into a plurality of reduced volume cells.

20. A method as defined in claim 19 further comprising the step of reducing the thickness of the adhesive pattern at preselected locations so as to form predetermined weakened areas that will rupture in a controlled manner in the event pressure between the cover and the substrate exceeds a predetermined safe threshold.

21. A lightning surge resistor network as defined in claim 5 wherein said adhesive is a film on said cover.

22. A lightning surge network comprising:

a substantially planar substrate;

a thick-film resistor deposited on said substrate; and a cover planar on said substrate and overlying at a distance spaced above said thick-film resistor, said cover adhered to said substrate with an adhesive located adjacent to the outer periphery of said cover, such that said outer periphery of said cover completely surrounds said resistor and said resistor is enclosed between said substrate and said cover.

23. A lightning surge resistor network as defined in claim 22 wherein said adhesive film is of reduced dimension adjacent preselected locations of said outer periphery so as to form areas of reduced adhesive strength adjacent said preselected locations.

24. A lightning surge resistor network as defined in claim 22 wherein said adhesive film further includes at least one cross-segment extending between points on said outer periphery so as to subdivide the region surrounded by said outer periphery into a plurality of cells.

25. A lightning surge resistor network as defined in claim 24 wherein any arcing that occurs in said thick-film resistor is confined within the cell in which said arcing occurs.

26. A lightning surge resistor network as defined in claim 24 wherein said adhesive film is of reduced dimension adjacent preselected locations of said outer periphery so as to form areas of reduced adhesive strength adjacent said preselected locations.

27. A method of containing arcing in a lightning surge resistor network of the type having a thick-film resistor deposited onto a substantially planar substrate, said method comprising:

providing a cover of sufficient dimension to overly and to be spaced a distance above the thick-film resistor;

depositing an adhesive on said cover in a predetermined pattern;

mounting said cover over the thick-film resistor; and adhering said cover to said substrate with said adhesive.

28. The method of claim 27 further comprising the step of forming said adhesive pattern to subdivide the volume defined between said cover and said substrate into a plurality of reduced volume cells.

29. The method of claim 28 further comprising the step of reducing the thickness of said adhesive pattern at preselected locations to form predetermined weakened areas to rupture in a controlled manner when pressure between said cover and said substrate exceeds a predetermined safe threshold.

* * * * *